US011807989B2

(12) United States Patent
Ha et al.

(10) Patent No.: US 11,807,989 B2
(45) Date of Patent: Nov. 7, 2023

(54) METHOD FOR MANUFACTURING ECO-FRIENDLY ANTIBACTERIAL COATED PAPER

(71) Applicant: Kosko Paper Co., Ltd., Pocheon-si (KR)

(72) Inventors: Young-chul Ha, Seoul (KR); Yeong-gyu Park, Seoul (KR)

(73) Assignee: KOSKO PAPER CO., LTD., Pocheon-si (KR)

( * ) Notice: Subject to any disclaimer, the term of this patent is extended or adjusted under 35 U.S.C. 154(b) by 114 days.

(21) Appl. No.: 17/354,292

(22) Filed: Jun. 22, 2021

(65) Prior Publication Data

US 2022/0403600 A1 Dec. 22, 2022

(51) Int. Cl.

| | |
|---|---|
| ***D21H 21/36*** | (2006.01) |
| ***D21H 19/12*** | (2006.01) |
| ***D21H 19/20*** | (2006.01) |
| ***D21H 19/32*** | (2006.01) |

(52) U.S. Cl.

CPC ..... *D21H 21/36* (2013.01); *D21H 19/12* (2013.01); *D21H 19/20* (2013.01); *D21H 19/32* (2013.01)

(58) Field of Classification Search

CPC ..... D21H 19/20; D21H 17/37; D21H 19/12; D21H 21/16; D21H 21/14; D21H 21/00; D21H 21/36; D21H 19/64; D21H 19/32; C09D 183/04; C09D 133/00; C09D 7/63

See application file for complete search history.

(56) References Cited

U.S. PATENT DOCUMENTS

| | | | | |
|---|---|---|---|---|
| 3,804,668 | A * | 4/1974 | Bakule | D21H 19/12 162/138 |
| 10,034,478 | B2 * | 7/2018 | Krasnow | A61K 8/25 |
| 2013/0052356 | A1 * | 2/2013 | Li | C09D 123/0853 524/521 |
| 2019/0144738 | A1 * | 5/2019 | Agrawal | C09K 8/805 166/280.2 |
| 2022/0380591 | A1 * | 12/2022 | Payne | C09J 143/04 |
| 2022/0380981 | A1 * | 12/2022 | Zeits | C09D 5/022 |
| 2023/0118447 | A1 * | 4/2023 | Tiwary | C09D 5/4415 428/447 |

FOREIGN PATENT DOCUMENTS

| | | | | |
|---|---|---|---|---|
| CN | 104795250 | A * | 7/2015 | C09D 5/00 |
| CN | 103975107 | B * | 9/2016 | B32B 1/02 |
| EP | 3898776 | B1 * | 3/2023 | C08G 77/06 |
| ES | 2445945 | T3 * | 3/2014 | A01N 25/10 |
| GB | 1431851 | A * | 4/1976 | D21H 17/37 |
| KR | 10-0549018 | | 2/2006 | |
| KR | 101159530 | B1 * | 6/2012 | B41M 5/42 |
| KR | 10-1537769 | | 7/2015 | |
| KR | 10-2015-0109227 | | 10/2015 | |
| KR | 10-2016-0034950 | | 3/2016 | |
| KR | 20160035576 | A * | 3/2016 | Y02A 40/90 |
| KR | 101737002 | B1 * | 5/2017 | Y02A 40/90 |
| KR | 10-1769000 | | 8/2017 | |
| KR | 10-2006945 | | 8/2019 | |
| KR | 10-2036171 | | 10/2019 | |
| TW | I742020 | B * | 11/2015 | C09J 11/04 |
| WO | WO-2013029992 | A1 * | 3/2013 | D21H 19/32 |
| WO | WO-2015111866 | A1 * | 7/2015 | B31C 7/02 |
| WO | WO-2016087597 | A1 * | 6/2016 | |
| WO | WO-2021094437 | A1 * | 5/2021 | C09D 5/00 |

* cited by examiner

*Primary Examiner* — Jose A Fortuna
(74) *Attorney, Agent, or Firm* — KILE PARK REED & HOUTTEMAN PLLC

(57) ABSTRACT

The present invention relates to a method for manufacturing an eco-friendly antibacterial polymer-coated paper in which an antibacterial coating agent is coated without releasing harmful substances to humans on the surface of a paper to ensure antibacterial activity and is easy to separate from the paper to enable their recycling. The method includes mixing 40 to 50% by weight of a mixture of methyl methacrylate and butyl acrylate, 0.5 to 3.0% by weight of a copper nanopowder, 0.5 to 2.0% by weight of an initiator, 1 to 5% by weight of a polymeric dispersant, and a balance of water to prepare a mixed solution, stirring the mixed solution at 70 to 80° C. for 5 to 10 hours for polymerizing the mixture to prepare a polymeric coating agent, and coating the polymeric coating agent to a thickness of 5 to 10 μm on a paper.

15 Claims, No Drawings

METHOD FOR MANUFACTURING ECO-FRIENDLY ANTIBACTERIAL COATED PAPER

BACKGROUND OF THE INVENTION

1. Field of the Invention

The present invention relates to a method for manufacturing an eco-friendly antibacterial coated paper in which an antibacterial coating agent is coated without releasing harmful substances to humans on the surface of a paper to ensure antibacterial activity and is easy to separate from the paper to enable their recycling.

2. Description of the Related Art

Papers are generally coated with coating agents for the purpose of improving functionalities such as strength, water resistance, oil resistance, and stiffness and aesthetics such as whiteness and brightness. Such coating agents can be usually classified into oil-based coating agents using organic solvents, water-based coating agents using water as a solvent, and ultraviolet (UV) coating agents that are cured by ultraviolet light.

Typical components for paper coating include various general-purpose synthetic resins such as polyethylene, polypropylene, polyvinyl chloride, and urethane, inorganic fillers, dispersants, binders, dyes, and rheology modifiers for viscosity adjustment.

Polyethylene is widely used as a synthetic resin for paper coating. In general, polyethylene is light, antirust, and rot resistant as well as has good chemical safety, water resistance, flexibility, insulation, and formability. Due to these advantages, polyethylene is widely used as a chemical in the manufacture of daily life products.

Polyethylene is suitable for food hygiene and is produced at a relatively low cost. For these reasons, polyethylene coated on paper surface is mainly used for food applications. For paper coating of polyethylene, auxiliary agents are further required to impart plasticity or thermal adhesiveness to final coated papers. However, such auxiliary agents may adversely affect humans during coating and may release environmental hormones when the coated papers are discarded.

Polyethylene is coated on papers at a high temperature of about 200° C. However, even if it is desired to regenerate and recycle pulp from polyethylene coated papers after use, pulp is almost impossible to recover and is entirely burnt or buried. Pulp is continuously consumed in the manufacture of coated papers, resulting in increased resource consumption and environmental destruction. Further, exhaust gases generated during incineration of coated papers cause air pollution and a long time is required for natural decomposition of coated papers even after burial.

Polyethylene coating is problematic in terms of hygiene and safety because some working conditions increases the risk of exposure to environmental hormones and carcinogens and long-term exposure to such harmful substances has lethal effects on human health. Particularly, upon contact with hot materials (≥100° C.), polyethylene releases environmental hormones that cause serious problems.

Under such circumstances, water-based coating agents or UV coating agents have attracted attention as eco-friendly products because they release no harmful substances during coating and are easy to recycle. However, UV coating agents are expensive and coating with UV coating agents require pricey equipment for UV curing. For these reasons, there has been growing interest in water-based coating agents.

Water-based coating agents physically form coating films by solvent evaporation and have the function of surface protection. Water-based coating agents use water-based synthetic polymeric resins as major components and various additives to impart necessary properties to coating films.

Acrylic resins, alkyd/polyester resins, polyurethane resins, and epoxy resins have been developed and commercialized as water-based synthetic resins for water-based coating agents. Among them, acrylic resins are most widely used for water-based coating agents. Various additives such as surfactants, solvents, waxes, and defoaming agents are used to improve the workability of water-based coating agents and the surface state of coating films and protect the surface of coating films.

Coated papers manufactured by coating such coating agents on the surface of papers should have good water and oil resistance and are required to have excellent antibacterial properties and chemical safety when used in foods. In addition, coated papers should be safe during manufacturing and recyclable after use.

Korean Patent No. 1769000 proposes a paper coating composition including a styrene-acrylic copolymer, a wax, isopropyl alcohol, a silicone-based defoaming agent, and an anionic surfactant. This patent also proposes an antibacterial coating composition for foods including an inorganic antibacterial agent including a silicate mineral, a clay mineral, and metal ions.

The presence of the clay mineral and the metal ions harmless to humans ensures antibacterial activity of the coating composition. The styrene-acrylic copolymer increases the printability of inks, that is, the adsorptivity of printed inks to the coating. However, since the components of the inorganic antibacterial agent have poor adhesion to a paper, the adhesion between the coating layer and the paper after coating is low, posing a risk that the coating layer may be peeled off from the paper.

Further, Korean Patent No. 2006945 proposes an eco-friendly recyclable waterproof coated paper in which the adhesion between the coating layer and the paper is high and from which pulp can be recovered after use. The coating layer is waterproof and includes a polyolefin resin coated on one or both sides of the paper, inorganic particles, a polar group-containing polyolefin resin, and porous ceramic particles.

The inorganic particles facilitate separation of the coating layer from the paper to enable recycling of the coated paper. The polar group-containing polyolefin resin forms hydrogen bonds with the hydroxyl groups of cellulose as a major component of the paper and strong secondary bonds such as ion-dipole and dipole-dipole interactions and is thus effective in increasing the adhesion between the coating layer and the paper.

The inorganic particles lowers the binding between the paper and the coating layer and the polar group-containing polyolefin resin increases the binding between the paper and the coating layer, with the result that the inorganic particles may separate the coating layer from the paper during use depending on the paper material or the manufacturing method or the polar group-containing polyolefin resin may make it difficult to recycle the coated paper after use and the polyolefin resin may increase the risk of exposure of humans to environmental hormones and carcinogens during coating.

Korean Patent No. 2036171 proposes a paper coating agent for food packaging including a water-soluble resin, a plasticized cellulose derivative, a slip agent, and a dispersant. The plasticized cellulose derivative is prepared by adding a plasticizer to the cellulose derivative. Smectite particles are added to the cellulose derivative. Calcium and sodium ions in the layered structure of the smectite particles are replaced by zinc or copper ions.

The paper coating agent has good water resistance, oil resistance, and blocking resistance. Due to these advantages, a packaging paper coated with the paper coating agent has high functionalities suitable for food packaging and suppresses the emission of volatile organic compounds causing environmental problems to provide beneficial effects in terms of human health.

However, since the plasticized cellulose derivative is viscous, foreign matter is easy to adhere to the packaging paper and the coated surface is made uneven. These problems are avoided by the addition of the slip agent and the dispersant to make the coating surface smooth and improve the storage stability of the coating agent. However, these additives disrupt the chemical balance of the coating agent, adversely affecting the overall physical properties of the coating film.

SUMMARY OF THE INVENTION

The present invention has been made in an effort to solve the above problems and intends to provide a method for manufacturing an antibacterial coated paper that does not adversely affect humans during coating, has high adhesion between the coating layer and the paper, and can be recycled through pulp recovery when discarded.

One aspect of the present invention provides a method for manufacturing an eco-friendly antibacterial coated paper, including: mixing 40 to 50% by weight of a mixture of methyl methacrylate and butyl acrylate as acrylic monomers in a weight ratio of 1:4 to 4:1, 0.5 to 3.0% by weight of a copper nanopowder, 0.5 to 2.0% by weight of an initiator, 1 to 5% by weight of a polymeric dispersant, and a balance of water to prepare a mixed solution; stirring the mixed solution at 70 to 80° C. for 5 to 10 hours to prepare a coating agent; and coating the coating agent to a thickness of 5 to 10 μm on a paper and drying the coating agent.

The copper nanopowder is preferably a nanopowder of cuprous oxide or cupric oxide.

The initiator is preferably an organic alkali metal derivative. More preferably, the initiator is selected from n-butyllithium, sec-butyllithium, t-butyllithium, n-decyllithium, eicosyllithium, lithium methoxide, lithium ethoxide, phenyllithium, 1-naphthyllithium, p-tolyllithium, and mixtures thereof.

The polymeric dispersant is preferably a water-based polysiloxane resin. The water-based polysiloxane resin is more preferably terminated with alkoxy groups.

3 to 7% by weight of rosin is preferably added to the mixed solution. More preferably, abietic acid obtained by solid-liquid separation of rosin after heating to 140 to 160° C. is added to the mixed solution or a product with an acid value of 30 or less obtained by dissolving rosin in a polyhydric alcohol, heating the solution at 250 to 350° C. for 1 to 3 hours, and removing the polyhydric alcohol is added to the mixed solution.

The copper nanopowder is preferably added while stirring a mixture of the acrylic monomers, the initiator, the dispersant, and the water.

The drying is preferably performed at 85 to 125° C., more preferably at a temperature by 5 to 10° C. higher than the boiling point of butanol produced from the butyl acrylate.

The method of the present invention enables the manufacture of a coated paper that has high antibacterial activity and waterproofness and is thus useful for surface coating of food. The method of the present invention releases no volatile organic compounds. The coating components of the coated paper are not dissolved in water upon contact with water during use, causing no environmental problems and no harm to human health. In addition, the coating layer and the paper can be easily separated from each other after use, enabling the recycling of the paper.

Furthermore, the coating film is firmly bound to the paper and is thus not easily peeled off from the paper. Printing can be performed on the coating film formed by coating the coating agent on the paper, and as a result, the applicability of the coated paper can be extended.

DETAILED DESCRIPTION OF THE INVENTION

The present invention provides a method for manufacturing an eco-friendly antibacterial coated paper by mixing a mixture of methyl methacrylate (MMA) and butyl acrylate (BA) as acrylic monomers, a copper nanopowder, an initiator, and a polymeric dispersant in water to prepare a water-based coating agent, heating the water-based coating agent to polymerize the acrylic monomers, followed by coating on a paper. A coated paper manufactured by the method of the present invention is harmless to the environment and humans and has high antibacterial activity and waterproofness. The coating layer and the paper can be easily separated from each other after use, enabling their recycling.

Acrylic resins are widely used in the industry. Methyl methacrylate and butyl acrylate are the most commonly used monomers for the production of acrylic resins. Various acrylic resin products can be produced depending on the contents of monomers. Generally, copolymers of 50% by weight of methyl methacrylate and 50% by weight of butyl acrylate are widely used for coating. Copolymers containing 90% by weight or more of butyl acrylate are mainly used as adhesives.

Methyl methacrylate and butyl acrylate have similar characteristics because of their similar acrylate molecular structures. However, polymethyl methacrylate, a methyl methacrylate homopolymer, exhibits the same characteristics as hard plastics, whereas polybutyl acrylate, a butyl acrylate homopolymer, exhibits the same characteristics as rubbers and adhesives.

A mixture of the methyl methacrylate and the butyl acrylate as acrylic monomers in a weight ratio of 1:4 to 4:1 is used in the method of the present invention. The coating agent containing a polymer of the monomers forms a coating film that benefits from the advantages of polymethyl methacrylate (hardness) and polybutyl acrylate (high bonding strength). Thus, the coating film is firmly bound to the surface of the paper.

The acrylic polymer has high mechanical strength, is harmless to the environment and humans, and has good heat resistance, waterproofness, chemical resistance, and oil resistance. Due to the advantages of the acrylic polymer, a packaging paper coated with the acrylic polymer does not lose its durability even upon contact with a water-containing object such as a food. In addition, the acrylic polymer is viscous enough to firmly attach the coating agent to the paper.

The mixture of the methyl methacrylate and the butyl acrylate as acrylic monomers may be present in an amount of 40 to 50% by weight, based on the weight of the coating agent. As the total amount of the acrylic monomers in water increases, the acrylic monomers tend to aggregate during polymerization, and as a result, their dispersion state is not maintained. However, ionic polymerization can make the molecular weight of the acrylic polymer uniform, and as a result, uniform physical properties of the coating film can be ensured despite the presence of a large amount of the acrylic monomers in the coating agent.

The coating film formed on the surface of the paper after coating and drying is composed of the solid components without water. If the total content of the acrylic monomers is less than the lower limit defined above (i.e. the relative content of water increases), more drying time is required to remove water and more costs are required to store and distribute the coating agent. Meanwhile, if the total content of the acrylic monomers exceeds the upper limit defined above, the dispersion state of the acrylic monomers is difficult to maintain and aggregation of the acrylic polymer occurs.

Copper is used to impart antibacterial activity to the surface coating film of the coated paper. The copper nanopowder has an average particle diameter of 1 to 100 nm. The copper nanopowder is uniformly dispersed in the coating agent due to its small particle diameter and can maintain high antibacterial activity due to its large surface area. In addition, the highly dispersible nanopowder is not precipitated even when the solids content of the coating agent increases. As a result, the drying time required to remove water during coating can be reduced.

However, since copper tends to oxidize when exposed to the atmosphere, cuprous oxide ($Cu_2O$) or cupric oxide (CuO) nanopowder is used as the copper nanopowder to prevent copper particles from rapid oxidation.

Copper ions are easier to elute from cuprous oxide than from cupric oxide. The eluted copper ions coming into contact with microorganisms bind to enzymes and proteins of the microorganisms to deteriorate the activities of the enzymes and proteins, impairing the metabolic functions of the microorganisms. Due to their catalytic activity, the eluted copper ions can convert oxygen in the air into reactive oxygen species to degrade organic matter of microorganisms and kill microorganisms. For these reasons, cuprous oxide with high antibacterial and antiviral activity is more preferably used in the coating agent than cupric oxide.

The copper nanopowder is preferably added in an amount ranging from 0.5 to 3.0% by weight, based on the weight of the coating agent. If the amount of the copper nanopowder is less than 0.5% by weight, sufficient antibacterial effects may not be expected. Meanwhile, if the amount of the copper nanopowder exceeds 3.0% by weight, the copper nanopowder may be precipitated in the coating solution or may be precipitated on the paper during drying after coating, and as a result, the addition of the copper in an excessive amount does not contribute to further improvement of antibacterial effects.

The initiator is a material that induces the initiation of chain ionic polymerization of the methyl methacrylate and the butyl acrylate. The initiator is preferably an organic alkali metal derivative, more preferably an organolithium compound.

The organolithium compound may be selected from aliphatic monolithium initiators, aromatic initiators, and mixtures thereof. Examples of the aliphatic monolithium initiators include n-butyllithium, sec-butyllithium, t-butyllithium, n-decyllithium, eicosyllithium, lithium methoxide, and lithium ethoxide. Examples of the aromatic initiators include phenyllithium, 1-naphthyllithium, and p-tolyllithium.

A high concentration of the initiator in the coating solution increases the polymerization rate but leads to an unstable state of the emulsion. Further, the viscous coating solution tends to coagulate. Thus, it is preferable that the initiator is added in an amount of 0.5 to 2.0% by weight, based on the weight of the coating agent.

The dispersant is used to disperse the solid components of the coating agent without being precipitated in water. Any component that can induce a uniform dispersion of the solid particles may be used without limitation as the dispersant. The dispersant is preferably a polymeric dispersant that is not dissolved in hot water rather than a low molecular weight dispersant (e.g., a soap component) that may be dissolved in hot water. A water-based polysiloxane resin can be used as the polymeric dispersant. The weight average molecular weight of the polysiloxane resin is 20000 or less, preferably 10000 to 20000.

Polysiloxane is excellent in heat and cold resistance, weather resistance, electrical insulation, water repellency, flame retardancy, and oil resistance, as well as has high dispersion performance. Polysiloxane can maintain its physical properties in a wide temperature range of −100 to 250° C. Due to these advantages, polysiloxane can be used in paper coating agents for a wide variety of applications.

Polysiloxane is viscous enough to adhere well to a paper, but it is preferable to increase the bonding strength of the coating agent such that the coating agent is used in a wider range of applications.

For this purpose, polysiloxane terminated with alkoxy groups (RO—) is preferable as the dispersant. Paper is mainly composed of cellulose having terminal hydroxyl groups. In the course of heating and curing the coating agent coated on the paper, the terminal alkoxy groups of the polysiloxane are condensed with the hydroxyl groups of cellulose and the resulting alcohol molecules escapes to form covalent bonds between the polysiloxane and the cellulose. Accordingly, the presence of the polysiloxane terminated with alkoxy groups in the coating agent allows the coating film to be more firmly bound to the paper.

The polymeric dispersant may be added in an amount of 1 to 5% by weight, based on the weight of the coating solution. If the content of the polymeric dispersant is less than 1% by weight, the solid particles are not uniformly dispersed. Meanwhile, if the content of the polymeric dispersant exceeds 5% by weight, it is difficult to expect satisfactory dispersion efficiency despite the addition of the polymeric dispersant in an excessive amount and there is a risk that the physical properties of the coating film may be impaired.

The coated paper may be deformed when used. The coated paper may be repeatedly bent and deformed, especially when used for food packaging. In this case, cracks are likely to occur in the coating film due to fatigue deterioration of the coating film.

This problem can be solved by further adding rosin to the coating agent. Rosin is a sticky and hydrophobic natural resin and is prepared by distillation of pine resin to remove volatile turpentine oil. Rosin has a softening point of 70 to 80° C., a melting point of 120 to 135° C., and an acid value of 155 to 175. Rosin contains abietic acid as a major component and resin acids such as neoabietic acid, levopimaric acid, hydroabietic acid, pimaric acid, and dextonic acid. Rosin is an environmentally friendly material that is excellent in adhesiveness, gloss, hardness, abrasion resistance, and hydrophobicity and does not release harmful substances.

The addition of rosin to the coating agent enables control over the viscoelastic properties of the coating film and imparts appropriate hardness and deformability to the coating film so that fatigue deterioration can be suppressed even when the coated paper is repeatedly deformed. Due to its ability to form a film, rosin can block moisture to maintain the strength of the coated paper even when the coated paper is in contact with water.

However, considering that rosin has a softening point of 70 to 80° C. and a melting point of 120 to 135° C., rosin is not melted but is softened upon contact with a hot beverage to cause a feeling of repulsion in a user. Accordingly, it is necessary to raise the softening point of rosin. To this end, it is preferable that the rosin is heated to volatilize and remove low boiling point components therefrom.

When rosin is heated to 140 to 160° C., rosin components with a melting point of 135° C. or less are liquefied but abietic acid having a melting point of 172 to 175° C. is not melted. Therefore, heating of rosin to 140 to 160° C. enables removal of low boiling point components through solid-liquid separation and extraction of high boiling point abietic acid.

According to another approach to increase the softening point of rosin, rosin is esterified by dissolving in an alcohol and heating the solution to allow the carboxyl group of abietic acid, a major component of rosin, to react with the hydroxyl group of the alcohol. The esterification raises the softening point of rosin and converts the carboxyl group into an ester group to lower the acid value of rosin to 30 or less, with the result that the weather resistance and adhesiveness of the coating agent material are improved and fast drying is enabled, achieving improved coating workability.

The alcohol is preferably a polyhydric alcohol. In this case, the rosin is subjected to esterification by heating at 250 to 350° C. for 1 to 3 hours and the polyhydric alcohol is removed by suitable processes such as drying or filtration. The extracted abietic acid or the esterified rosin is preferably finely pulverized before mixing with the coating agent because it may agglomerate during extraction or esterification.

When the coating agent is coated on the paper, heated, and cured, the methyl group of the methyl methacrylate and the butyl group of the butyl acrylate are condensed with the terminal hydroxyl groups of cellulose constituting the paper to produce alcohols.

Rosin is insoluble in water but is soluble in organic solvents. Accordingly, rosin is dissolved in the alcohols produced during heating and curing of the coating agent before coating on the paper. Due to its water insolubility, the rosin is not dissolved in water even when the rosin-containing coated paper is in contact with water.

The rosin is preferably finely powdered for easy dissolution in an alcohol. The rosin is preferably mixed in an amount of 3 to 7% by weight, based on the weight of the coating agent. If the amount of the rosin is less than 3% by weight, it is difficult to prevent the occurrence of cracks in the coating film upon repeated bending and deformation of the coated paper. If the amount of the rosin exceeds 7% by weight, there is a risk that the coating film may not be formed uniformly and an increase in manufacturing cost is incurred.

The mixture of the methyl methacrylate and the butyl acrylate as acrylic monomers, the copper nanopowder, the initiator, and the polymeric dispersant are mixed with water, rosin is optionally added to the mixed solution, followed by stirring at 70 to 80° C. for 5 to 10 hours. At this time, ionic polymerization of the methyl methacrylate and the butyl acrylate affords the coating agent. Since the copper nanopowder has a tendency to settle down in the course of polymerization, it is preferable that the copper nanopowder is added during polymerization for its dispersion in the coating agent.

Acrylic resins are generally prepared by radical polymerization. Such acrylic resins have a broad molecular weight distribution, which explains their non-uniform physical properties. In contrast, the method of the present invention is based on ionic polymerization in the presence of an organic alkali metal derivative as an initiator. As a result of this ionic polymerization, the molecular weight of the polymer is made uniform, ensuring uniform physical properties of the coating agent and the coating film.

Next, the coating agent is coated to a thickness of 5 to 10 μm on the paper and dried to form the coating film. If the coating film is thinner than 5 μm, a long time is required to remove water and coating defects may occur. If the coating film is thicker than 10 the physical properties of the coating film may be adversely affected.

A polyethylene- or polypropylene-based coating agent is physically attached to a paper by coating in a lamination process. The coating agent is not uniformly laminated on the paper and the coating quality is often excessive when the film is not thicker than 20 μm. Particularly, a polyethylene coating film is prepared at a high temperature of about 200° C. and laminated on a paper. Thermal decomposition of the film is prevented by the addition of one or more additives selected from heat stabilizers (mainly metal oxides), antioxidants, and lubricants in the course of film formation. However, these additives may be dissolved in water and may thus be harmful to humans.

The water-based coating agent is based on acrylic resins that have carbon-oxygen unsaturated bonds in the carbonyl groups. Since the highly reactive acrylic resins chemically adhere to the paper, the quality of the coating film can be adjusted at a thickness of 5 μm or more depending on the application of the coated paper.

In the course of heating and curing of the coating agent, the methyl group of the methyl methacrylate and the butyl group of the butyl acrylate are condensed with the terminal hydroxyl groups of cellulose of the paper to form covalent bonds between the acrylic resins and the cellulose. The coating agent is firmly bound to the paper through the covalent bonds.

The alcohols produced as a result of the condensation reaction can dissolve the rosin to help form the coating film but adversely affect the adhesive strength and film-forming properties of the coating agent. In view of this, it is preferable to remove the alcohols after formation of the coating film. Specifically, methanol produced as a result of the condensation of the methyl methacrylate is removed by evaporation during drying. Butanol is produced as a result of the condensation of the butyl acrylate. There are four butanol isomers: tert-butanol having a boiling point of 82.5° C., sec-butanol having a boiling point of 99.5° C., isobutanol having a boiling point of 108° C., and n-butanol having a boiling point of 117.7° C. Accordingly, it is preferable to dry the coating film at 85 to 125° C. where these butanol isomers can be vaporized. It is more preferable to heat and dry the coating film at a temperature by 5 to 10° C. higher than the boiling point of butanol produced from the butyl acrylate.

The coating agent causes no environmental problems and no harm to humans because it is soluble in water and is prepared at a low temperature without releasing volatile organic compounds. The polymeric dispersant is not substantially dissolved in water, thus being suitable for food applications.

Lamination coating has the disadvantage that a resin and a paper are not easily separated from each other, making it difficult to recycle the paper. In contrast, the method of the present invention has the advantage that biodegradable polymethyl methacrylate and polybutyl acrylate are hydrolyzed in their side chains, making it possible to separate the resins from the paper and to recycle the paper.

When the coated paper is immersed in a weakly alkaline aqueous solution of sodium hydroxide (NaOH) at 90° C. after use, hydrolysis occurs at the interface between the paper and the coating agent, with the result that the paper and the coating agent are separated from each other and are recyclable.

Information printed on a polyethylene coating film can be erased by a simple external force because polyethylene is non-polar. Accordingly, information is previously printed on a paper and a polyethylene coating agent is then coated thereon. In contrast, according to the present invention, since the polar acrylic polymers have good printing durability, information can be printed on the coating film after the coating agent is coated on the paper. This can extend the applicability of the coated paper.

The present invention will be explained more specifically with reference to the following examples, including preparative examples and test examples.

However, these examples are provided for illustrative purposes only and the present invention is not limited thereto. It will be apparent to those skilled in the art that various modifications and their equivalents can be made in the present invention without departing from the spirit and scope of the invention.

Example 1

Methyl methacrylate and n-butyl acrylate were mixed in a molar ratio of 1:1. 4.5 kg of the acrylic monomer mixture, 130 g of lithium methoxide as a polymerization initiator, 300 g of water-based polysiloxane as a polymeric dispersant, and 4.9 kg of purified water were placed in a flask equipped with a stirrer.

The stirrer was operated and the mixture was heated to 75° C. for 1 h. Then, 170 g of a cuprous oxide nanopowder was added to the flask. The resulting mixture was heated for 7 h while maintaining the temperature at 75° C., affording a coating agent in which the acrylic monomers were polymerized.

The coating agent was coated on one side of a 250 μm-thick paper using a comma coater and dried at 125° C. for 10 min to manufacture a coated paper in which a 6 μm-thick coating film was formed.

Example 2

500 g of glycerol was mixed with 1 kg of rosin. The mixture was subjected to esterification with stirring under heating at 300° C. for 2 h. When the acid value of the product was lowered to ≤30, heating was stopped and residual glycerol was removed by filtration. A coated paper was manufactured in the same manner as in Example 1, except that 500 g of the esterified rosin was further added to the flask, the stirrer was operated, and the mixture was heated.

Example 3

Tetraethoxysilane was allowed to react with water. The alcohol produced as a result of hydrolytic condensation and the reaction solvent were distilled off at the boiling point to prepare a water-based polysiloxane resin in which ethoxy groups were introduced.

A coated paper was manufactured in the same manner as in Example 1, except that the water-based polysiloxane was used as a polymeric dispersant.

Comparative Example 1

Ethylene containing 1.7 wt % of a cuprous oxide nanopowder was polymerized by a low-pressure process (catalyst:triethyl aluminium+titanium tetrachloride, solvent:hydrocarbon oil, pressure:ambient pressure, temperature: 70° C.) to prepare a coating agent.

The coating agent was coated on one side of a 250 μm-thick paper by coating in a lamination process to manufacture a coated paper. The coating film was formed as thin as possible. The thickness of the coating film was 110 μm, which was larger than that of the coating film formed in Example 1.

Comparative Example 2

A coated paper was manufactured in the same manner as in Example 1, except that soap was used as a dispersant instead of the water-based polysiloxane.

<Test Example 1> Adhesiveness and Durability Evaluation

The adhesive strength between the coating film and the paper surface in each of the coated papers manufactured in Examples 1-3 and Comparative Examples 1-2 was measured using a tensile tester (1605HTP, Aikoh, Japan). The coated paper was cut and formed into paper cups. Room temperature water, carbonated drink, and coffee (95° C.) were separately placed in the paper cups and stored at room temperature for 8 h. The cups were observed for changes in appearance and leakage. The results are shown in Table 1.

TABLE 1

Results of evaluation of adhesiveness and durability

| | | Example 1 | Example 2 | Example 3 | Comparative Example 1 | Comparative Example 2 |
|---|---|---|---|---|---|---|
| Adhesive strength (g/8 mm$^2$) | | 557 | 551 | 565 | 573 | 541 |
| Durability | Room temperature water | ○/● | ○/● | ○/● | ○/● | ○/▲ |
| | Carbonated drink | ○/● | ○/● | ○/● | ○/● | ○/▲ |
| | Coffee | ○/● | ○/● | ○/● | ○/● | Δ/xx |

(Durability)
Appearance: No change (○), Slight change (Δ), Severe change (x)
Leakage: Not observed (●), Slight leakage (▲), Severe leakage (xx)

As can be seen from the results in Table 1, the coated papers of Examples 1-3 showed high adhesive strengths (551-565 g/8 mm$^2$) and the coated paper of Comparative Example 1 showed a high adhesive strength of 573 g/8 mm$^2$. In contrast, the coated paper of Comparative Example 2 showed the lowest adhesive strength (541 g/8 mm$^2$).

The high adhesive strength of the coating agent of Comparative Example 1 was explained by polyethylene coating on the paper in a lamination process. The use of soap as a low molecular weight dispersant was responsible for the low adhesive strength of the coating agent of Comparative Example 2.

No changes in the appearance of the paper cups formed from the coated papers of Examples 1-3 and Comparative Example 1 and no leakage from the paper cups were observed (durability evaluation). Slight leakage of room temperature water and carbonated drink and severe leakage of hot coffee through the seams of the paper cups formed from the coated paper of Comparative Example 2 were observed. The appearance of the paper cup containing hot coffee was slightly deformed.

The use of the polymers of methyl methacrylate and n-butyl acrylate as resin components of the coating agents in Examples 1-3 led to slightly low adhesive strengths compared to the use of the ethylene polymer in Comparative Example 1. Analysis of these results reveals that the coated papers of Examples 1-3 can be used for food applications such as paper cups and the coated paper of Comparative Example 2 has poor durability due to its low adhesive strength, limiting its use.

<Test Example 2> Antibacterial Activity Measurement

The antibacterial activities of the coated papers manufactured in Examples 1-3 and Comparative Examples 1-2 against *Staphylococcus aureus* (ATCC 6538P) and *Escherichia coli* (ATCC 8739) were measured according to KS M ISO 22196 (measurement of antibacterial activity on plastics and other non-porous surfaces). The activities were expressed in percentages. The results are shown in Table 2.

TABLE 2

Results of antibacterial activity measurement

| | Example 1 | Example 2 | Example 3 | Comparative Example 1 | Comparative Example 2 |
|---|---|---|---|---|---|
| *Staphylococcus aureus* | >99.9% | >99.9% | >99.9% | 97.5% | >99.9% |
| *Escherichia coli* | >99.9% | >99.9% | >99.9% | 96.7% | >99.9% |

The coated papers of Examples 1-3 and Comparative Example 2 showed antibacterial activities of >99.9%, demonstrating the antibacterial effect of the copper nanopowder. The lower antibacterial activity of the coated paper of Comparative Example 1 is believed to be because the coating film (110 μm thick) of the coated paper of Comparative Example 1 was thicker than the coating films of the other coated papers, resulting in the exposure of a small amount of the copper particles on the surface of the coating film of the coated paper of Comparative Example 1 relative to the amount of the copper nanopowder in the coating agent.

In conclusion, the antibacterial activity of the coating film increases when a larger amount of the antibacterial material is more exposed on the surface of the coating film and the amount of the surface-exposed antibacterial material relative to the amount of the antibacterial material used is maximized. In addition, the amount of the antibacterial material needs to be reduced for cost saving and the thickness of the coating film needs to be minimized for more surface exposure of the antibacterial material.

<Test Example 3> Food Safety

The safeties of the coated papers of Examples 1-3 and Comparative Examples 1-2 for food applications were evaluated according to "III. Specifications for Individual Materials-4. Paper or Processed paper" in "Standards and Specifications for Food Utensils, Containers and Packages" established by the Ministry of Food and Drug Safety of Korea. The coated paper was judged as "suitable" when it passed all tests in the residue specifications and migration specifications and "unsuitable" when it failed any one of the tests.

TABLE 3

Results of evaluation of food safety

| | Example 1 | Example 2 | Example 3 | Comparative Example 1 | Comparative Example 2 |
|---|---|---|---|---|---|
| Judgement | Suitable | Suitable | Suitable | Unsuitable | Unsuitable |

As can be seen from the results in Table 3, the coated papers of Examples 1-3 were judged to cause no problems when used in foods. In contrast, the coating agents prepared in Comparative Examples 1 and 2 were unsuitable for food applications because the anti-cracking agents (Comparative Example 1) and the soap component as a low molecular weight dispersant (Comparative Example 2) were dissolved in water.

<Test Example 4> Recyclability

The recyclability of each of the coated papers of Examples 1-3 and Comparative Examples 1-2 was evaluated after dissociation in an alkaline solution in accordance with "8 Test Methods—8.2 Test method for alkaline dissociation and alkaline dispersibility" in "Eco-label Certification Standards (EL606)" established by the Ministry of Environment of Korea.

The coated paper was judged to be "recyclable" when no impurities were present and no stickiness was observed in the resulting pulp. The time required to recover pulp from the recyclable sample by dissociation was measured. The results are shown in Table 4.

TABLE 4

| Results of evaluation of recyclability | | | | | |
|---|---|---|---|---|---|
| | Example 1 | Example 2 | Example 3 | Comparative Example 1 | Comparative Example 2 |
| Recyclability | Recyclable | Recyclable | Recyclable | Unrecyclable | Recyclable |
| Dissociation time (min) | 36 | 47 | 42 | ≥100 | 33 |

Each of the coated papers of Examples 1-3 and Comparative Example 2 was judged to be recyclable because no impurities were present and no stickiness was observed in the resulting pulp after dissociation in an alkaline solution. The coated paper of Comparative Example 2, which was manufactured using the low molecular weight dispersant, was found to be the most advantageous in terms of recyclability because its dissociation time was the shortest.

Since the coated paper of Comparative Example 1 where polyethylene was laminated on the paper surface was hardly dissociated, it was judged that the pulp was not recyclable.

What is claimed is:

1. A method for manufacturing an eco-friendly antibacterial polymer-coated paper, the method comprising:

mixing 40 to 50% by weight of a mixture of methyl methacrylate and butyl acrylate as acrylic monomers in a weight ratio of 1:4 to 4:1, 0.5 to 3.0% by weight of a copper nanopowder, 0.5 to 2.0% by weight of an initiator, 1 to 5% by weight of a polymeric dispersant, and a balance of water to prepare a mixed solution;

stirring the mixed solution at 70 to 80° C. for 5 to 10 hours for polymerizing the mixture and thereby forming a polymeric coating agent; and coating the polymeric coating agent to a thickness of 5 to 10 μm on a paper and drying the polymeric coating agent.

2. The method according to claim 1, wherein the copper nanopowder is a nanopowder of cuprous oxide or cupric oxide.

3. The method according to claim 1, wherein the initiator is an organic alkali metal derivative.

4. The method according to claim 1, wherein the initiator is selected from n-butyllithium, sec-butyllithium, t-butyllithium, n-decyllithium, eicosyllithium, lithium methoxide, lithium ethoxide, phenyllithium, 1-naphthyllithium, p-tolyllithium, and mixtures thereof.

5. The method according to claim 1, wherein the polymeric dispersant is a water-based polysiloxane resin.

6. The method according to claim 5, wherein the water-based polysiloxane resin is terminated with alkoxy groups.

7. The method according to claim 1, wherein 3 to 7% by weight of a rosin is added to the mixed solution.

8. The method according to claim 7, wherein the rosin comprises abietic acid obtained by solid-liquid separation of the rosin after heating to 140 to 160° C. is added to the mixed solution.

9. The method according to claim 7, wherein:

the rosin comprises an esterified rosin with an acid value of 30 or less is added to the mixed solution; and the esterified rosin is obtained by dissolving the rosin in a solution comprising polyhydric alcohol, heating the solution at 250 to 350° C. for 1 to 3 hours, and removing the polyhydric alcohol from the solution.

10. The method according to claim 1, wherein the copper nanopowder is added while stirring a mixture of the acrylic monomers, the initiator, the polymeric dispersant, and the water.

11. The method according to claim 1, wherein the drying is performed at 85 to 125° C.

12. The method according to claim 11, wherein the drying is performed at a temperature by 5 to 10° C. higher than the boiling point of butanol produced from the butyl acrylate.

13. A method for manufacturing an eco-friendly antibacterial polymer-coated paper, the method comprising:

mixing 40 to 50% by weight of a mixture of methyl methacrylate and butyl acrylate as acrylic monomers in a weight ratio of 1:4 to 4:1, 0.5 to 3.0% by weight of a copper nanopowder, 0.5 to 2.0% by weight of an initiator, 1 to 5% by weight of a polymeric dispersant, 3 to 7% by weight of a rosin, and a balance of water to prepare a mixed solution;

stirring the mixed solution at 70 to 80° C. for 5 to 10 hours for polymerizing the mixture to prepare a polymeric coating agent; and coating the polymeric coating agent to a thickness of 5 to 10 μm on a paper and drying the polymeric coating agent.

14. The method according to claim 13, wherein the rosin comprises abietic acid having a melting point of 172 to 175° C.

15. The method according to claim 13, wherein the rosin comprises an esterified rosin having an acid value of 30 or less.

* * * * *